US006705958B2

(12) United States Patent
Hayashi et al.

(10) Patent No.: US 6,705,958 B2
(45) **Date of Patent: *Mar. 16, 2004**

(54) GOLF BALL

(75) Inventors: Junji Hayashi, Chichibu (JP); Yutaka Masutani, Chichibu (JP); Hisashi Yamagishi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/170,592

(22) Filed: Jun. 14, 2002

(65) Prior Publication Data

US 2003/0008730 A1 Jan. 9, 2003

Related U.S. Application Data

(60) Provisional application No. 60/300,859, filed on Jun. 27, 2001.

(30) Foreign Application Priority Data

Jun. 19, 2001 (JP) ..... 2001-185471

(51) Int. Cl.[7] ..... A63B 37/06

(52) U.S. Cl. ..... 473/377; 473/378; 473/371

(58) Field of Search ..... 524/406, 432; 473/371, 372, 373, 363, 305, 374, 378; 528/76, 83

(56) References Cited

U.S. PATENT DOCUMENTS

| | | | | |
|---|---|---|---|---|
| 4,337,947 | A | * | 7/1982 | Saito et al. |
| 5,872,185 | A | * | 2/1999 | Ichikawa et al. ..... 525/93 |
| 6,054,550 | A | * | 4/2000 | Umezawa et al. |
| 6,121,357 | A | * | 9/2000 | Yokota |
| 6,329,458 | B1 | * | 12/2001 | Takesue et al. |
| 6,348,016 | B2 | * | 2/2002 | Nakamura ..... 473/371 |
| 6,561,926 | B2 | * | 5/2003 | Hayashi et al. ..... 473/372 |
| 6,575,849 | B2 | * | 6/2003 | Hayashi et al. ..... 473/377 |
| 2003/0022735 | A1 | * | 1/2003 | Hayashi et al. ..... 473/377 |

FOREIGN PATENT DOCUMENTS

| | | |
|---|---|---|
| JP | 06-277312 | 10/1994 |
| JP | 2000-005341 A | 1/2000 |

* cited by examiner

*Primary Examiner*—Thanh Duong
*Assistant Examiner*—Tom P Duong
(74) *Attorney, Agent, or Firm*—Sughrue Mion, PLLC

(57) ABSTRACT

A golf ball includes a core, and a cover made from a cover material containing an ionomer resin and also barium sulfate and titanium dioxide added in a total amount ranging from 10 to 25 parts by mass on the basis of 100 parts by mass of the ionomer resin. A flexural amount of the core, measured by applying a load of 980 N thereto, is in a range of 4.0 to 5.5 mm. A ratio of a melt-flow rate to a specific gravity (melt-flow rate/specific gravity) of the cover material is in a range of 1.6 or more. A Shore D hardness of the cover is in a range of 55 to 65.

14 Claims, 1 Drawing Sheet

GOLF BALL

CROSS REFERENCE TO RELATED APPLICATION

This application is an application filed under 35 U.S.C. §111(a) claiming benefit pursuant to 35 U.S.C §119(e)(i) of the filing date of the Provisional Application No. 60/300,859 filed on Jun. 27, 2001 pursuant to 35 U.S.C. §111(b).

BACKGROUND OF THE INVENTION

1. Field of the Invention

The present invention relates to a golf ball with high moldability due to high resin flowability, good appearance, and high resilience.

2. Prior Art

A method of improving a cover material by adding an inorganic filler (titanium dioxide and barium sulfate) thereto has been proposed, for example, in Japanese Patent Laid-open No. Hei 6-277312. The addition of titanium dioxide and barium sulfate to the cover of a golf ball is effective to give excellent properties such as a carrying performance to the golf ball. With respect to the reason for this, the document describes that the addition of titanium dioxide and barium sulfate to the cover "shifts a weight distribution in the ball from the core center to the cover side, to increase an inertia moment of the ball, thereby increasing the carry of the golf ball".

Such a proposal, however, has been required to be further improved in terms of factors determining golf ball performances, for example, a hardness factor of the cover and core, a composition factor of the cover and core, and a dimple factor. In particular, the ball disclosed in the embodiment of the above proposal has been required to be improved in terms of feeling of hitting the ball and the carry of the ball.

On the other hand, the properties of a golf ball strongly demanded by golf players are generally player's soft feeling at the time of hitting the ball and the carrying performance of the ball; however, it is regarded as difficult to make both the properties compatible with each other for the following reasons:

(1) If the core is softened for ensuring the player's soft feeling, a deformed amount of the hit ball becomes large, to degrade the durability against cracking.

(2) If both the core and cover are softened for ensuring both the player's soft feeling and durability against cracking, the resilience and initial velocity of the ball are reduced, to sacrifice the carrying performance.

(3) If the ball is excessively improved only in terms of the player's soft feeling, the other properties are sacrificed, to cause such an inconvenience that local deformation of the hit ball becomes large, not to keep the sphericalness of the ball at the initial stage of the carry of the ball, thereby degrading the carrying performance.

To solve the above problems, Japanese Patent Laid-open No. 2000-5341 has proposed an excellent golf ball characterized by combining a core, which is softened to improve the player's soft feeling and durability against cracking, with a cover to which a reinforcement filler is added.

Such a golf ball, however, has been required to be further improved in terms of moldability, resilience, and appearance.

SUMMARY OF THE INVENTION

An object of the present invention is to provide a golf ball with high durability and very high resilience.

As a result of an examination made, by the present inventor, to achieve the above object, it has been found that a golf ball including a core, and a cover made from a cover material containing an ionomer resin and also barium sulfate and titanium dioxide added in a total amount ranging from 10 to 25 parts by mass on the basis of 100 parts by mass of the ionomer resin; wherein a flexural amount of the core, measured by applying a load of 980 N thereto, is in a range of 4.0 to 5.5 mm, a ratio of a melt-flow rate to a specific gravity (melt-flow rate/specific gravity) of the cover material is in a range of 1.6 or more, and a Shore D hardness of the cover is in a range of 55 to 65, is advantageous in improving the productivity and exhibiting excellent properties as described below by a synergistic effect of the above-described optimized requirements.

(1) Since the kind and the content of an inorganic filler are optimized, more specifically, since the content of the inorganic filler is specified not to be excessively large, it is possible to improve the durability, and to prevent degradation of the resilience (carrying performance) and lowering of moldability (resin flowability) and hence to improve productivity.

(2) Since barium sulfate and titanium dioxide are used in combination as the inorganic filler, a durability improving effect can be given by addition of barium sulfate and a disadvantage that the cover becomes yellowish by addition of barium sulfate is canceled out by addition of titanium dioxide. As a result, it is possible to improve the durability while ensuring a good appearance by preventing the cover from becoming yellowish.

The present inventor has further found that the productivity and performances of the above-described golf ball can be further improved by optimizing dimples of the golf ball and the adjusting the composition of the cover material as follows:

(3) If a ball is relatively soft, the spin of the hit ball becomes small, and therefor, if the ballistic path of the ball is excessively low, the carry of the ball may become insufficient because of the "drop" of the ball. To cope with such an inconvenience, the dimple total volume ratio (VR) is specified, to prevent the "drop" of the ball, thereby ensuring a high carrying performance.

(4) The resilience (carrying performance) can be further improved and thereby the carry of the ball can be made further longer by specifying the kind of the ionomer resin.

On the basis of the above-described knowledge, the present invention has been accomplished.

Accordingly, the present invention provides the following golf balls:

(1) A golf ball including; a core; and a cover made from a cover material containing an ionomer resin and also barium sulfate and titanium dioxide added in a total amount ranging from 10 to 25 parts by mass on the basis of 100 parts by mass of the ionomer resin; wherein a flexural amount of the core, measured by applying a load of 980 N thereto, is in a range of 4.0 to 5.5 mm; a ratio of a melt-flow rate to a specific gravity (melt-flow rate/specific gravity) of the cover material is in a range of 1.6 or more; and a Shore D hardness of the cover is in a range of 55 to 65.

(2) A golf ball according to claim 1, wherein a thickness of the cover is in a range of 1.0 to 2.0 mm.

(3) A golf ball according to claim 1 or 2, wherein a specific gravity of the cover material is in a range of 1.020 to 1.110.

(4) A golf ball according to any one of claims 1 to 3, wherein the golf ball has in the cover surface a large number of dimples; and a dimple total volume ratio (VR) is in a range of 0.85% or less, the dimple total volume ratio being defined as a ratio of a total volume of dimple spaces each of which is present under a plane surface surrounded by an edge portion of the dimple to a total volume of a virtual ball being the same as the golf ball except that the virtual ball has no dimples.

(5) A golf ball according to any one of claims 1 to 4, wherein the ionomer resin contains an Li-ion neutralized type ionomer resin and an Mg-ion neutralized type ionomer resin.

(6) A golf ball according to any one of claims 1 to 5, wherein the added amount of barium sulfate is larger than that of titanium dioxide.

(7) A golf ball according to any one of claims 1 to 6. wherein the cover material contains, on the basis of 100 parts by mass of the ionomer resin, 7 to 20 parts by mass of barium sulfate and 2 to 7 parts by mass of titanium dioxide.

DETAILED DESCRIPTION OF THE INVENTION

Figure 1:
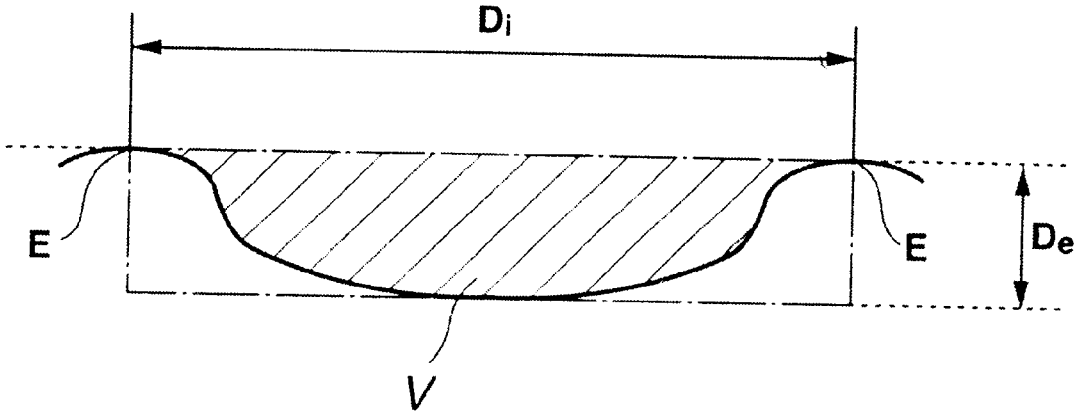
FIG. 1 is a sectional view showing one dimple of a golf ball illustrating the definition of the dimple total Volume ratio (VR).

The present invention will be hereinafter described in more detail. A golf ball of the present invention includes a solid core and a cover. The solid core is not particularly limited except that a flexural amount thereof is optimized as will be described later and can be produced from a known core material.

For example, the core material is represented by a rubber composition containing 1,4-cispolybutadiene as a main rubber component.

In addition to polybutadiene, another diene based rubber, such as styrene-butadiene rubber (SER), natural rubber, isoprene rubber, or ethylene-propylene-diene rubber (EPDM) may be suitably mixed in the above base rubber.

In addition to the main rubber component, unsaturated carboxylic acid and/or a metal salt thereof and an organic peroxide can be added to the above-described rubber composition.

Examples of the unsaturated carboxylic acids may include acrylic acid, metacrylic acid, maleic acid, fumaric acid. In particular, acrylic acid and metacrylic acid are preferably used.

Examples of the metal salts of unsaturated carboxylic acids may include zinc salts and magnesium salts of unsaturated aliphatic acids, for example, zinc metacrylate and zinc acrylate. In particular, zinc acrylate is preferably used.

The content of the unsaturated carboxylic acid and/or metal salt thereof may be set, on the basis of 100 parts by mass of the main rubber component, in a range of 10 parts by mass or more, preferably, 15 parts by mass or more, more preferably, 20 parts by mass or more, with the upper limit being in a range of 50 parts by mass or less, preferably, 45 parts by mass or less, more preferably, 40 parts by mass or less, most preferably, 35 parts by mass or less. If the content is excessively small, the resilience is reduced, and if excessively large, the solid core becomes excessively hard, which may sometimes make player's feeling of hitting of the golf ball undesirable.

As the organic peroxide, there can be used a commercial product such as "Percumyl D" (sold by NOF CORPORATION), "Perhexa 3M" (sold by NOF CORPORATION), "Luperco 231XL" (sold by Elf Atochem Japan). Two kinds or more organic peroxides may be used in combination as needed.

The content of the organic peroxide may be set, on the basis of 100 parts by mass of the main rubber component, in a range of 0.1 part by mass or more, preferably, 0.3 part by mass or more, more preferably, 0.5 part by mass or more, most preferably, 0.7 part by mass or more, with the upper limit being in a range of 5 parts by mass or less, preferably, 4 parts by mass or less, more preferably, 3 parts by mass or less, most preferably, 2 parts by mass or less. If the content is excessively large or small, the resilience, player's feeling of hitting the golf ball, and durability against cracking may be reduced.

In addition to the above-described essential components, an inorganic filler can be added to the rubber composition of the present invention for adjusting the specific gravity, as needed. Examples of the inorganic fillers may include zinc oxide, barium sulfate, and calcium carbonate. In order to obtain a suitable weight and desirable resilience, the content of the inorganic filler may be set, on the basis of 100 parts by mass of the main rubber component, in a range of 1 part by mass or more, preferably, 3 parts by mass or more, more preferably, 5 parts by mass or more, most preferably, 7 parts by mass or more, with the upper limit being in a range of 60 parts by mass or less, preferably, 50 parts by mass or less, more preferably, 45 parts by mass or less, most preferably, 40 parts by mass or less.

An antioxidant may be further added to the rubber composition of the present invention, as needed. As the antioxidant, there can be used a commercial product such as "NOCRAC NS-6, NS-30" (sold by Ouchi-Sinko Chemical Industrial Co., Ltd.), or "Yoshinox 425" (Yoshitomi Pharmaceutical Co., Ltd.). In order to obtain desirable resilience and durability, the content of the antioxidant may be set, on the basis of 100 parts by mass of the main rubber component, in a range of 0 part by mass or more, preferably, 0.05 part by mass or more, more preferably, 0.1 part by mass or more, most preferably, 0.2 part by mass or more, with the upper limit being in a range of 3 parts by mass or less, preferably, 2 parts by mass or less, more preferably, 1 part by mass or less, most preferably, 0.5 part by mass or less.

An organic sulfur compound can be further added to the rubber composition of the present invention. Examples of the organic sulfur compounds may include thiophenol, thionaphthol, halogenated thiophenol, or metal salts thereof. more concretely, zinc salts of pentachlorothiophenol, pentafluorothiophenol, pentabromothiophenol, and parachlorothiophenol; and diphenyl polysulfide, dibenzil polysulfide, dibenzoil polysulfide, dibenzothiazoil polysulfide, and dithiobenzoil polysulfide, each of which has the sulfur number of 2 to 4. In particular, a zinc salt of pentachlorothiophenol or diphenyl disulfide is preferably used. The content of the organic sulfur compound may be set, on the basis of 100 parts by mass of the main rubber component, in a range of 0.05 part by mass or more, preferably, 0.1 part by mass or more, more preferably, 0.2 part by mass or more, with the upper limit being in a range of 5 parts by mass or less, preferably, 4 parts by mass or less, more preferably, 3 parts by mass or less, most preferably, 2.5 parts by mass or less.

The solid core of the present invention can be formed by vulcanizing and heating the above-described rubber composition by a known process. For example, a vulcanizing temperature may be set in a range of 100 to 200° C., and a vulcanizing time be set in a range of 10 to 40 min.

According to the present invention, the hardness of the solid core, which is expressed in a flexural amount, that is, a deformed amount of the solid core measured by applying a load of 980 N (100 kg) thereto, may be set in a range of 4.0 mm or more, preferably, 4.2 mm or more, more preferably, 4.6 mm or more, with the upper limit being in a range of 5.5 mm or less, preferably, 5.3 mm or less, more preferably, 5.2 mm or less. If the flexural amount, that is, the flexural amount is excessively small, player's feeling of hitting the golf ball becomes harder, and particularly, the spin of the ball becomes excessively high at the time of long-shot with a driver when the ball is liable to be largely deformed, to reduce the carry of the ball, and if excessively large, player's feeling of hitting the ball becomes dull, the carry of the ball is reduced because of insufficient resilience, and durability against cracking due to repeated hitting is degraded.

The diameter of the solid core of the present invention may be set in a range of 38.0 mm or more, preferably, 38.5 mm or more, more preferably, 38.7 mm or more, most preferably, 38.9 mm or more, with the upper limit being in a range of 41.0 mm or less, preferably, 40.7 mm or less, more preferably, 40.3 mm or less, most preferably, 40.1 mm or less.

The specific gravity of the solid core may be set in a range of 1.000 or more, preferably, 1.050 or more, more preferably, 1.100 or more, with the upper limit being in a range of 1.300 or less, preferably, 1.250 or less, more preferably, 1.200 or less.

The golf ball of the present invention is a solid golf ball including the above-described solid core and a cover. Such a solid golf ball may be any one of a two-piece type including one cover layer and a multi-piece type including two or more cover layers. The solid golf ball of the present invention, however, is required to have a cover layer made from a specific cover material to be described later, irrespective of the type. According to the present invention, particularly, from the viewpoint of effectively achieving the effect of improving a golf ball, the golf ball may be of a two-piece solid golf ball.

The cover of the golf ball of the present invention is made from a cover material mainly containing an ionomer resin. As the ionomer resin, there can be used a commercial product, for example, "Surlyn 6320, 8120, 7930, or 9320" (Du Pont DE NEMOURS & COMPANY, USA), or "Himilan 1706, 1605, 1855, 1601, or 1557" (Du Pont-Mitsui Polychemicals Co., Ltd.).

To improve the resilience, the ionomer resin may be composed of an Li ion neutralized ionomer resin and an Mg ion neutralized ionomer resin. In this case, the mixing ratio in mass between the Li ion neutralized ionomer resin and the Mg ion neutralized ionomer resin may be set in a range of 95:5 to 10:90, preferably, 90:10 to 30:70. If the mixing ratio is out of the above range, it may fail to improve the resilience.

The cover material of the present invention is required to contain barium sulfate and titanium dioxide in combination. The optimization of the added amounts of both the components is effective to ensure a good appearance of the ball by preventing the ball surface from becoming yellowish as well as to improve the durability. The addition of only barium sulfate degrades the appearance, and the addition of only titanium dioxide degrades the durability.

According to the present invention, the total amount of barium sulfate and titanium dioxide is required to be set, on the basis of 100 parts by mass of the ionomer resin, in a range of 10 parts by mass or more, preferably, 11 parts by mass or more, more preferably, 12 parts by mass or more, with the upper limit being in a range of 25 parts by mass or less, preferably, 24 parts by mass or less, more preferably, 23 parts by mass or less. If the total amount is excessively small, the durability is degraded, and if excessively large, the resilience and moldability are degraded.

According to the present invention, to ensure a good appearance of the ball by preventing the ball surface from becoming yellowish as well as to improve the durability, the added amount of each of barium sulfate and titanium dioxide may be set as follows: namely, the added amount of barium sulfate may be set, on the basis of 100 parts by mass of the ionomer resin, in a range of 7 parts by mass or more, preferably, 8 parts by mass or more, with the upper limit being in a range of 20 parts by mass or less, preferably, 19 parts by mass or less; and the added amount of titanium dioxide may be set, on the basis of 100 parts by mass of the ionomer resin, in a range of 2 parts by mass or more, preferably, 3 parts by mass or more, with the upper limit being in a range of 7 parts by mass or less, preferably, 6 parts by mass or less. In this case, the total amount of both the components may be adjusted not to be out of the above-described range.

The cover material of the present invention is specified such that a ratio of a melt-flow rate (measured at 190° C. and a test load of 21.18 N (2.16 kgf) under JIS-K7210) to a specific gravity (melt-flow rate/specific gravity, which is hereinafter referred to as "resin flow volume index") is in a range of 1.6 or more, preferably, 1.8 or more, more preferably, 2.0 or more. The cover material having a resin flow volume index specified in the above range can exhibit high flowability and high moldability, and thereby high productivity, and particularly, such a cover material is suitable for injection molding.

The melt-flow rate of the cover material may be in a range of 1.7 dg/mm or more, preferably, 1.8 dg/min or more.

The specific gravity of the cover material may be in a range of 1.020 or more, preferably, 1.030 or more, more preferably, 1.040 or more, with the upper limit being in a range of 1.110 or less, preferably, 1.090 or less.

In addition, a UV absorbent, an antioxidant, a dispersant, and a coloring agent may be added to the cover material, as needed.

The cover of the golf ball of the present invention can be formed by a known process of putting the solid core in a specific mold for injection molding, and injection-molding the cover material. Alternatively, the cover can be formed by preparing a pair of cup-halves made from the cover material, putting the solid core covered with the cup-halves in a specific mold, and press-molding the resultant solid core covered with the cup-halves.

The Shore D hardness of the cover of the golf ball of the present invention may be set in a range of 55 or more, preferably, 56 or more, more preferably, 57 or more, with the upper limit being in a range of 65 or less, preferably, 64 or less, more preferably, 63 or less. In this way, the cover of the golf ball is relatively harder than a cover of a general golf ball; however, the cover can exhibit desirable resilience while keeping high durability against cracking. If the hardness is higher than the above range, player's feeling of hitting the ball is degraded, and if lower than the above range, the resilience is reduced.

In spite of the type of the golf ball, that is, a two-piece solid golf ball or a multi-piece solid golf ball (in this case, the thickness of a cover is the total thickness of cover layers), the thickness of the cover may be set in a range of 1.0 mm or more, preferably, 1.2 mm or more, with the upper limit being in a range of 1.3 mm or less, preferably, 2.0 mm or less, more preferably, 1.9 mm or less.

Like a general golf ball, the golf ball of the present invention has in the cover surface a large number of dimples. These dimples are required to be optimized for obtaining a desirable carry of the ball by preventing the drop of the ball.

The optimization of the dimples will be described with reference to FIG. 1. FIG. 1 is an enlarged sectional view of one dimple illustrating the definition of a VR (Volume Ratio) of dimples according to the present invention. In the figure, the right and left top points E at the edge portion of the dimple are horizontally positioned, and the deepest portion of the dimple having a maximum depth De is located at the center of the dimple.

To be more specific, the top points E are defined as points at which a dimple diameter Di crosses a circle formed by the edge portion of the dimple, and the maximum depth De is defined as a distance from a line connecting the points E to each other to the deepest portion of the dimple. Each dimple volume V is defined as a volume of the dimple space present under the plane surface surrounded by the edge portion of the dimple.

According to the present invention, the dimples are optimized by specifying a dimple total volume ratio (VR) in a range of 0.85% or less, preferably, 0.84% or less, more preferably, 0.83% or less. The dimple total volume ratio (VR) is defined as a ratio of a total volume of dimple spaces each of which is present under a plane surface surrounded by an edge portion of the dimple to a total volume of a virtual ball being the same as the golf ball except that the virtual ball has no dimples. With this optimization of the dimples, it is possible to prevent the drop of the hit ball, and hence to improve the carry of the ball.

The volume V of each dimple can be measured, for example, by a measurement apparatus described in Japanese Patent Laid-open No. Hei 11-30508. If the dimples are not optimized as described above, the hit ball may be dropped, to reduce the carry of the ball. In addition, there is no limitation to the total number, kinds, shape, and the like of the dimples. For example, the total number of the dimples may be set in a range of 350 pieces or more, preferably, 370 pieces or more, with the upper limit being in a range of 500 pieces or less, preferably, 480 pieces or less. The kinds of the dimples may be set in a range of two or more, preferably, three or more. The shape of each dimple is not limited to the circular shape, and the diameter of each dimple may be set in a range of 2.0 mm or more, preferably, 2.2 mm or more, with the upper limit being in a range of 5.0 mm or less, preferably, 4.8 mm or less.

The golf ball of the present invention can be produced with its diameter and weight specified under a golf rule for golf games. Concretely, the diameter of the golf ball can be set in a range of 42.67 mm or more, with the upper limit being in a range of 44.0 mm or less, preferably, 43.5 mm or less, more preferably, 43.0 mm or less, and the weight of the golf ball can be set in a range of 45.93 g or less, with the lower limit being in a range of 44.5 g or more, preferably, 44.8 g or more, more preferably, 45.0 or more.

EXAMPLE

The present invention will be more clearly understood by way of, while not limited thereto, the following examples and comparative examples.

Examples 1 to 3 and Comparative Examples 1 to 3

A rubber composition for a solid core was prepared by mixing respective core components with 100 parts by mass of polybutadiene (BR11, BR18, sold by Japan Synthetic Rubber Co., Ltd.) as shown in Table 1, and a solid core was produced from the rubber composition. In Table 1, "Percumyl D" (sold by NOF CORPORATION) was used as dicumyl peroxide, and "NOCRAK NS-6" (sold by Ouchi-Sinko Chemical Industrial Co., Ltd.) was used as an antioxidant.

A cover material having a composition shown in Table 1 was prepared, and physical properties thereof were examined. Commercial products used for the cover material and methods of measuring the physical properties of the cover material are as follows;

Surlyn

This is an ionomer resin sold by Du Pont DE NEMOURS & COMPANY, USA. A metal name in each parenthesis designates a metal ion type used neutralization.

Himilan

This is an ionomer resin sold by Du Pont-Mitsui Polychemicals Co., Ltd. A metal name in each parenthesis designates a metal ion type used neutralization.

Shore D Hardness

The hardness not on the surface of the ball but on the surface of the resin sheet was measured under JIS-K 6253 by using a duro-meter of Type D under ASTM D2240.

Melt-flow Rate

The melt-flow rate was measured under JIS-K7210 (test temperature; 190° C., test load: 21.18 N (2.16 kgf))

Specific Gravity

The specific gravity of the sheet-shaped cover material was measured by using a specific gravity meter.

Thickness of Cover

The thickness of the cover was calculated on the basis of a relationship of (outer diameter of ball—outer diameter of core)/2.

Outer Diameter of Ball

The outer diameter of the ball at a portion with no dimple was measured.

Dimple VR

The dimple total volume ratio (VR) was determined by measuring each dimple volume in accordance with an apparatus and a method disclosed in Japanese Patent Laid-open No. Hei 11-30508.

Durability of Ball

Each ball was hit against a steel plate at a speed of 55 m/s, and the number of cracking was measured. The durability of the ball was expressed in an index which was the number of cracking on the basis (100) of the number of cracking of a commercial two-piece solid golf ball (PRECEPT MC LADY, sold by Bridgestone Sports Co. Ltd.).

Flexural Amount Measured by Applying Loaf of 980 N

The flexural amount (mm), that is, deformed amount (mm) of each of the solid core and ball at the time of applying a load of 980 N (100 kg) thereto was measured.

Appearance

The surface of each of the produced golf balls was visually observed.

Physical Properties of Golf Ball

The ball was hit with a swing robot (Miyamae Co. Ltd.), to which a driver (PRO230Titan, sold by Bridgestone Sports Co., Ltd.) was mounted, at a head speed of 45 m/s, and the carry (total) of the ball was measured. The initial velocity and spin of the ball immediately after hitting were measured by using a high-speed camera.

TABLE 1

| | | | Example | | | Comparative example | | |
|---|---|---|---|---|---|---|---|---|
| | | | 1 | 2 | 3 | 1 | 2 | 3 |
| Core | Composition (parts by mass) | Polybutadiene BR11 | 70 | 70 | 70 | 70 | 70 | 70 |
| | | Polybutadiene BR18 | 30 | 30 | 30 | 30 | 30 | 30 |
| | | Zinc acrylate | 22.7 | 22.6 | 22.7 | 22.3 | 22.7 | 22.7 |
| | | Zinc oxide | 5.0 | 5.0 | 5.0 | 5.0 | 5.0 | 5.0 |
| | | Barium sulfate | 12.4 | 15.0 | 12.4 | 20.2 | 10.2 | 12.4 |
| | | Antioxidant | 0.1 | 0.1 | 0.1 | 0.1 | 0.1 | 0.1 |
| | | Dicumyl peroxide | 1.4 | 1.4 | 1.4 | 1.4 | 1.4 | 1.4 |
| | Outside diameter (mm) | | 39.1 | 39.2 | 39.1 | 39.0 | 39.1 | 39.1 |
| | Weight (g) | | 35.1 | 35.8 | 35.1 | 36.3 | 34.5 | 35.1 |
| | Hardness (mm) | | 5.0 | 4.6 | 5.0 | 4.6 | 4.9 | 5.0 |
| Cover | Composition (parts by mass) | Surlyn 7930 (Li) | 66 | 66 | 66 | | | |
| | | Surlyn 6320 (Mg) | 34 | 34 | 34 | | | |
| | | Himilan 1557 (Zn) | | | | 52 | | 35 |
| | | Himilan 1601 (Na) | | | | 48 | | |
| | | Himilan 1605 (Na) | | | | | 82 | 30 |
| | | Himilan 1855 (Zn) | | | | | | 15 |
| | | Surlyn 8120 (Na) | | | | | | 20 |
| | | Surlyn 9320 (Zn) | | | | | 18 | |
| | | Barium sulfate | 15 | 8 | 15 | | 27 | |
| | | Zinc oxide | | | | | | 24.5 |
| | | Titanium dioxide | 5 | 5 | 5 | 5 | 0 | 5 |
| | | Magnesium stearate | 1 | 1 | 1 | 1 | 1 | 1 |
| | | Pigment | 0.05 | 0.05 | 0.05 | 0.05 | 0.05 | 0.05 |
| | Shore D hardness | | 60 | 59 | 60 | 59 | 60 | 62 |
| | Specific gravity | | 1.090 | 1.040 | 1.090 | 0.980 | 1.140 | 1.165 |
| | Melt-flow rate (dg/min) | | 2.2 | 2.3 | 2.2 | 2.2 | 2.8 | 1.0 |
| | Melt-flow rate / specific gravity | | 2.0 | 2.2 | 2.0 | 2.2 | 2.5 | 0.9 |
| | Thickness (mm) | | 1.8 | 1.8 | 1.8 | 1.8 | 1.8 | Non-moldable |
| Dimple | Number | | 432 | 392 | 392 | 392 | 392 | |
| | VR (%) | | 0.77 | 0.78 | 0.78 | 0.78 | 0.91 | |
| Ball | Outside diameter (mm) | | 42.7 | 42.7 | 42.7 | 42.7 | 42.7 | |
| | Weight (g) | | 45.0 | 45.0 | 45.0 | 45.2 | 45.1 | |
| | Hardness (mm) | | 4.1 | 3.9 | 4.1 | 3.9 | 4.0 | |
| | Apperance | | Good | Good | Good | Good | Yellowish | |
| | Durability | | 110 | 105 | 110 | 55 | 120 | |
| | Initial speed (m/s) | | 64.9 | 65.0 | 64.9 | 65.0 | 64.6 | |
| | Spin (rpm) | | 2180 | 2250 | 2190 | 2240 | 2180 | |
| | Carry (m) | | 223.2 | 222.9 | 222.1 | 222.8 | 218.5 | |

As is apparent from the results shown in table 1, each of the golf balls in Examples 1 to 3 can be easily produced because of high moldability of the cover material, and exhibit a good appearance being not yellowish, and very high resilience. On the contrary, each of the golf balls in Comparative Examples 1 to 3 has the following disadvantages:

Comparative Example 1

The golf ball in this example, which uses a common cover material, is good in resilience and carry, but is very poor in durability and is therefore not usable because the cover material does not contain barium sulfate.

Comparative Example 2

The golf ball in this example is good in durability but is poor in resilience because the cover material contains only barium sulfate in a large amount and contains no titanium dioxide. Also, since the ball is soft, the spin is low, and since the VR of the dimples is excessively high, the ballistic path is excessively low and thereby the carry of the ball is short. Further, the appearance of the ball is significantly yellowish.

Comparative Example 3

In the golf ball in this example, since zinc oxide added in the cover material in place of barium sulfate reacts with the ionomer resin, the flowability is significantly lowered, thereby failing to obtain a desired resin flow volume index. As a result, the resin cannot sufficiently flow in a mold at the time of injection molding, and thereby it cannot be molded.

As described above, the golf ball of the present invention has high moldability because of high resin flowability, good appearance, and very high resilience.

What is claimed is:

1. A golf ball comprising:

a core having a flexural amount thereof, measured by applying a load of 980 N thereto, is in a range of 4.0 to 5.5 mm; and a cover made from a cover material containing an ionomer resin and also barium sulfate and titanium dioxide added in a total amount ranging from 10 to 25 parts by mass on the basis of 100 parts by mass of said ionomer resin; wherein the added amount of barium sulfate is larger than that of titanium dioxide;

a ratio of a melt-flow rate to a specific gravity (melt-flow rate/specific gravity) of said cover material is in a range of 1.6 or more; and a Shore D hardness of said cover is in a range of 55 to 65, wherein said ionomer resin contains an Li-ion neutralized type ionomer resin and an Mg-ion neutralized type ionomer resin.

2. A golf ball according to claim 1, wherein a thickness of said cover is in a range of 1.0 to 2.0 mm.

3. A golf ball according to claim 1, wherein a specific gravity of said cover material is in a range of 1.020 to 1.110.

4. A golf ball according to claim 1, wherein said golf ball has a large number of dimples in the cover surface; and a dimple total volume ratio (VR) is in a range of 0.85% or less, said dimple total volume ratio being defined as a ratio of a total volume of dimple spaces each of which is present under a plane surface surrounded by an edge portion of said dimple to a total volume of a virtual ball being the same as said golf ball except that said virtual ball has no dimples.

5. A golf ball according to claim 1, wherein said cover material contains, on the basis of 100 parts by mass of said ionomer resin, 7 to 20 parts by mass of bariumsulfate and 2 to 7 parts by mass of titanium dioxide.

6. A golf ball according to claim 1, wherein said core is formed of rubber composition containing 1,4-cispolybutadiene as a main rubber component.

7. A golf ball according to claim 1, wherein said core has a specific gravity in a range of 1.0 to 1.3.

8. A golf ball according to claim 1, wherein the ratio of melt-flow rate to the specific gravity of the cover material is set in a range of 1.8 or more.

9. A golf ball according to claim 1, wherein the mixing ratio in mass between the Li-ion neutralized ionomer resin and an Mg-ion neutralized ionomer resin is set in a range of 95:5 to 10:90.

10. A golf ball according to claim 6, wherein said core has an inorganic filler such as zinc oxide, barium sulfate, and calcium carbonate.

11. A golf ball according to claim 4, wherein each dimple has a diameter from 2.0 to 5.0 mm and the golf ball having two or more types of dimples, and the number of dimples is set in a range of 350 to 500.

12. A golf ball comprising:

a core having a flexural amount thereof, measured by applying a load of 980 N thereto, is in a range of 4.0 to 5.5 mm; and a cover made from a cover material containing an ionomer resin, and barium sulfate and titanium dioxide added in a total amount ranging from 10 to 25 parts by mass on the basis of 100 parts by mass of said ionomer resin, wherein said ionomer resin contains an Li-ion neutralized type ionomer resin and an Mg-ion neutralized type ionomer resin, a ratio of a melt-flow rate to a specific gravity (melt-flow rate/specific gravity) of said cover material is in a range of 1.6 or more; and a Shore D hardness of said cover is in a range of 55 to 65, wherein the mixing ratio in mass between the Li-ion neutralized ionomer resin and the Mg-ion neutralized ionomer resin is set in a range of 95:5 to 10:90.

13. A golf ball according to claim 12, wherein the added amount of barium sulfate is larger than that of titanium dioxide.

14. A golf ball according to claim 12, wherein said cover material contains, on the basis of 100 parts by mass of said ionomer resin, 7 to 20 parts by mass of barium sulfate and 2 to 7 parts by mass of titanium dioxide.

* * * * *